United States Patent [19]

Ludt et al.

[11] 4,021,792

[45] May 3, 1977

[54] SMOKE ALARM

[75] Inventors: Roy R. Ludt, Alhambra; Carl A. Eggert, Canoga Park; John Skarman, Whittier, all of Calif.

[73] Assignee: Wellen Industries, Monterey Park, Calif.

[22] Filed: June 23, 1975

[21] Appl. No.: 589,420

[52] U.S. Cl. ..... 340/237.5; 250/574; 356/207; 340/251

[51] Int. Cl.[2] ..... G08B 17/10

[58] Field of Search ..... 340/237, 251; 250/564, 250/565, 574, 575, 552, 573; 356/207

[56] References Cited

UNITED STATES PATENTS

| | | | |
|---|---|---|---|
| 2,537,028 | 1/1951 | Cahusac et al. | 340/237.5 X |
| 3,505,529 | 4/1970 | Moore | 340/237.5 X |
| 3,576,558 | 4/1971 | Devries | 340/237.5 X |
| 3,585,621 | 6/1971 | DiCello | 340/237.5 X |
| 3,774,186 | 11/1973 | Enemark | 340/237.5 |
| 3,868,184 | 2/1975 | Marsocci | 340/237.5 X |

FOREIGN PATENTS OR APPLICATIONS

| | | | |
|---|---|---|---|
| 1,222,351 | 2/1971 | United Kingdom | 340/237.5 |

*Primary Examiner*—John W. Caldwell
*Assistant Examiner*—Daniel Myer
*Attorney, Agent, or Firm*—Spensley, Horn, Jubas & Lubitz

[57] ABSTRACT

A smoke alarm having a smoke chamber with at least two inlet ports together with an array of louvered apertures and flue means to provide free access to the smoke chamber for smoke flowing in any direction within a hemispherical zone. A circuit employing photocells to measure smoke obscuration and reflection by means of an improved wheatstone bridge to sound a loud audible alarm. A relaxation oscillator coupled to a light source which is used for the optical portion of the smoke alarm. The oscillator produces an alarm to indicate failure of the light source, which alarm is distinguishable from the smoke alarm. A heat sink thermally coupled to the light source to induce filament vapors to condense on non-critical portions of the light source.

5 Claims, 6 Drawing Figures

SMOKE ALARM

BACKGROUND OF THE INVENTION

1. Field of the Invention

This invention relates to detection apparatus and, more particularly, to apparatus for detecting the presence of smoke or other solids in suspension in a gas by means of optical measurement of the optical scattering coefficient and obscuration of such a gas.

2. Description of the Prior Art

One of the leading causes of fatalities in structural fires is not heat or actual burns but suffocation by smoke inhaled by the sleeping victims. Furthermore, additional fatalities and injuries are caused by the lack of an early warning system during those times or in those locations in which the occupants of a structure are generally unaware or unable to detect a sudden fire.

In response to these hazards, smoke detectors have been devised in order to warn or waken occupants of the accumulation of smoke in order to prevent both suffocation by smoke inhalation and to provide an early warning signal to facilitate safe escape. Prior art devices for the detection of smoke have included various types of electrical discharge devices and ionization devices. However, such devices often entail the use of high voltage sources, complex circuitry and tend to have a sensitivity which is undesirably dependent upon ambient relative humidity and other factors which may affect the ionization or discharge rates of the detecting devices.

The simplest and more common mode for detection of gases and suspended particles in gases by the prior art has been by optical means. Optical detection of smoke densities has generally been accomplished by measuring: (1) the amount of optical obscuration or attenuation of a light beam; (2) the amount of scattering from a light beam caused by the smoke particles; or (3) by a combination of both. In those cases where the measurement of the optical density of smoke has been solely by measuring the obscuration or scattering caused by smoke, the devices have been vulnerable to changes in supply voltage, temperature, dust and grease accumulations, filament age, and detector degradation. The use of two detectors, one balanced against the other, to measure the obscuration and scattering of light from a beam caused by smoke is in large part directed to solve these disadvantages.

In general, one light detection means or photoelectric cell is positioned to measure the amount of light in a beam which traverses a smoke chamber. A second light detection means or photoelectric cell is oriented to measure light scattered in a generally perpendicular direction from the beam when smoke is introduced into the chamber. Thus, by balancing the electrical responses of the two photo cells one against the other, periodic changes in the photo cells and light source as well as degradation caused by aging could be nulled out and the overall operation of the circuitry maintained in a stable mode. However, where two such photoelectric cells have been balanced against each other they have generally been deployed in a "bucking" circuit across a relay coil. See U.S. Pat. No. 2,476,958 and U.S. Pat. No. 2,640,123. Such an arrangement is dependent upon a delicately balanced and adjusted relay. Thus the system is characterized by a lack of long term stability and requires periodic adjustment. Moreover, circuits employing relays are subject to the long term weaknesses and instability inherent to electromechanical devices which depend on mechanical springs and moveable, exposed electrical contacts.

A simpler and more reliable utilization of a two cell system to detect optical densities of smoke is to employ the photo cells in a wheatstone bridge. See for example, U.S. Pat. No. 3,409,885. Although coupling of the photoelectric cells in a wheatstone bridge has led to greater stability and sensitivity, such circuits have in general continued to use electromechanical devices at critical junctions in the circuit and have failed to provide for humidity stabilization of the bridge operation. In addition, such prior art claims have failed to combine the use of a bridge with photocells used in the reflection and obscuration modes. Thus, none of the prior art alarms incorporated any means capable of self-calibrating for the color of smoke.

The typical light source in all such optical mode detectors has been an incandescant bulb which has been installed without regard to vapor condensation on the interior surfaces of the bulb. In such cases where vaporized matter condenses on portions of the bulb used to transmit the principle beam of light, undesirable degradation of the light intensity has occurred over long periods of time.

In most cases prior art devices have failed to incorporate a fail-safe circuit which would generate a signal indicating failure of the optical portion of the system. In those cases where a fail-safe circuit and fail-safe signal is provided, the prior art has usually failed to provide a fail-safe signal which is distinguishable from the general smoke alarm signal, or where such capability has been provided, it has been achieved only by comparatively complex circuitry including electromechanical means.

Finally, prior art devices have generally failed to incorporate a simple means by which the entire circuitry and overall operation of the smoke alarm could be easily and periodically tested by means other than introducing an actual smoke sample into the device, or by means necessitating the removal of a portion of the device.

Therefore, what is needed is a smoke detection and alarm device having long term stability and reliability with high sensitivity irrespective of changes in voltage supply, temperature, dust and grease accumulation, filament age, detector degradation, smoke color, and humidity. In addition, what is needed is a fail-safe circuit, having high reliability simplicity and stability, capable of generating a fail-safe signal which is readily distinguishable from the general smoke alarm signal. What is also needed is a means for easily and periodically testing the overall operation of the device without actually introducing a smoke sample into the device, or without removal of any portion of the device.

SUMMARY OF THE INVENTION

The present invention is a smoke alarm having a light shielded smoke chamber with at least two apertures provided therein to permit smoke dispersed in the air to flow through a space defined by the chamber. A light source is disposed within the smoke alarm to transmit a beam of collimated light through at least a portion of the space defined by the smoke chamber. A first light detection means is disposed in a generally perpendicular direction to the beam of light propagating through the smoke chamber and is thus responsive to light scattered from the beam by smoke or other particles suspended in air flowing through the smoke chamber. A second light detection means is disposed so as to be responsive to the intensity of the beam of light after the beam has propagated along its predetermined path through the smoke chamber. A circuit means is coupled to the first and second light detection means. The circuit means compares electrical responses from each of the light detection means to determine whether or not a predetermined amount of smoke is present within the smoke chamber. The first detection means which is primarily responsive to light scattered from the beam by smoke particles is the primary triggering element. The second detection means which is primarily responsive to the amount of light propagated across the chamber in the main beam essentially calibrates the circuit means for temperature, dust and grease accumulations on the light detection means, detector aging, filament aging, and black smoke (which has a substantially different coefficient of scattering than white smoke). When the first and second light detection means indicate the presence of smoke equal to or greater than a predetermined value, the circuit means turns on a smoke warning alarm. Finally, the circuit means serves a fail-safe function by generating a fail-safe signal which is distinguishable from the smoke alarm signal. The fail-safe signal is generated whenever the light source means becomes inoperative and thus causes the smoke alarm's detection capability to become disabled.

In another embodiment of the present invention the smoke alarm includes a testing means for simulating the scattering of light from smoke within the smoke chamber. The testing means allows periodic and convenient testing of the operation of the entire smoke alarm without the need for introducing an actual sample of smoke into the smoke chamber or without necessitating removal of the cover or any other portion of the device. In one embodiment, the testing means is a small wire having a predetermined coefficient of optical scattering. The wire is introduced into the collimated beam of light within the smoke chamber in order to simulate scattering from the beam by smoke. In this manner, not only is the operation of the light source means tested but also the operation of the first and second light detection of the same. The introduction of the testing means into the collimated beam of light may be accomplished by depressing a shaft or button coupled to the wire. When the shaft or button is no longer depressed a spring means returns the wire to its normal position and withdraws it from the beam. The spring means may be a resilient reticulated foam baffle which also serves as a light baffle across a smoke access port provided in the smoke chamber walls.

The smoke chamber has a generally longitudinal axis with smoke ports provided therein a each end of the longitudinal axis. A third port may be provided on an axis which is substantially perpendicular to the longitudinal axis of the smoke chamber. Each of the smoke ports are provided with baffles which prevent the entry of ambient light into the smoke chamber, but which are substantially noninterferring with the free flow of smoke therethrough. At least one of these baffles may be a resilient reticular foam layer having a opague and nonporous plate disposed over the upper surface of the layer. The opague and and nonporous plate serves to prevent light from penetrating through the resilient reticular foam layer while smoke may freely enter the sides of the layer and flow through the baffled port into the smoke chamber.

An array of louvered openings is provided in a covering over the smoke alarm in a plane parallel to the longitudinal axis of the smoke chamber. The louvers are oppositely inclined in an alternating pattern so that smoke moving in either direction perpendicular to the longitudinal access of the smoke chamber is directed into the smoke alarm and into the proximity of a baffled port in the smoke chamber. Thus, smoke moving in either direction parallel to the longitudinal axis of the smoke chamber may freely enter the smoke chamber through the baffled ports provided at the ends of the longitudinal axis, and smoke moving in either direction perpendicular to the longitudinal axis of the smoke chamber may freely enter the smoke chamber via the array of louvered openings and the baffled port provided on an axis which is perpendicular to the longitudinal axis of the smoke chamber.

According to the present invention, when the light source means is an incandescent bulb a heat sink is thermally coupled to those portions of the bulb's surface which transmit light in a direction away from the desired collimated beam. Therefore, vaporized matter within the bulb tends to condense on those portions of the surface of the incandescant bulb which do not transmit light used in the collimated beam. Therefore, that portion of the bulb transmitting light in the desired beam direction remains substantially clear and the long term intensity of the bulb is increased.

In the present invention the circuit means is a wheatstone bridge having the light detection means as one series pair of the bridge while resistors form the other series pair. Both pairs are coupled in parallel. In contrast to the prior art, the resistor series pair has a relatively low impedance. By virtue of this low impedance, parallel current leakages across the resistive elements caused by changes in relative humidity become insignificant. Thereby, a bridge circuit is devised which is substantially independent of changes in relative humidity. When the light detection means achieve an electrical response having a predetermined ratio, the bridge circuit or sensing means generates a predetermined voltage which is coupled to an alarm means which in turn generates a smoke alarm signal. The light source means is also coupled to a fail-safe means, which may be a relaxation oscillator. The fail-safe means is triggered when the light source means increases unduly in impedance or open circuits. The fail-safe or relaxation oscillator is coupled to the alarm means, and when triggered causes the alarm means to generate a fail-safe signal which is distinguishable from the smoke alarm signal.

The novel features which are believed to be characteristic of the invention, both as to its organization and method of operation, together with further objects and advantages thereof will be better understood from the following description considered in connection the accompanying drawings in which the presently preferred embodiments of the invention are illustrated by way of example. It is to be expressly understood, however, that the drawings are for the purpose of illustration and description only and are not intended as a definition of the limits of the invention.

DESCRIPTION OF THE PREFERRED EMBODIMENT

The present invention is a smoke alarm which is capable of detecting a predetermined density of smoke by means of measurement of the optical density of the smoke ladden air. The smoke alarm comprises a smoke chamber having three baffled ports which, together with a louvered array of apertures in the smoke alarm housing, provides substantially hemispherical accessibility of the smoke chamber to air flow. The optical density of the smoke is measured by means of two light detection means in combination with a light source means and a circuit means. The first light detection means measures light scattered by smoke from a collimated beam of light generated by the light source means. The second light detection means is responsive to the intensity of the beam as it is transmitted through the smoke chamber. A circuit means compares responses from the first and second light detection means and generates an alarm signal when a predetermined response to light scattered from smoke within the chamber is detected. In addition, the circuit means generates a fail-safe signal when the light source means fails. The fail-safe signal is distinguishable from the alarm signal. The invention may be better understood in its various embodiments by referring to FIGS. 1–6.

Figure 1:
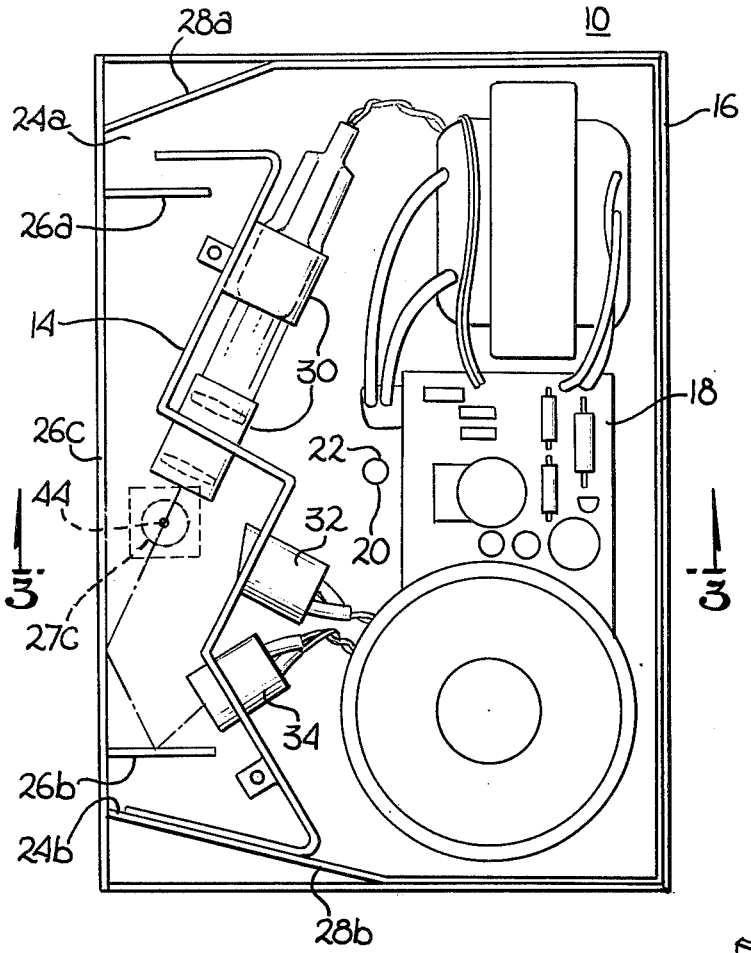
FIG. 1 is a plan view of the smoke alarm with the exterior cover removed showing the layout of the circuit means together with the smoke chamber.

Referring now to FIG. 1 smoke alarm 10 is shown in plan view with housing cover 12 (illustrated in FIG. 6) removed. Smoke alarm 10 is shown as having a smoke chamber 14 disposed on one side of a rectangular housing 16 with a circuit means 18 disposed on the other side of housing 16. The relative position of smoke chamber 14 and circuit means 18 may be chosen in any convenient manner desired. Exterior housing 12 is fastened to rectangular housing 16 by means of a hand tightened knob 20 and a threaded bolt 22 affixed to housing 16. The elements of smoke chamber 14 are shown in FIG. 1 and comprise smoke ports **24*a*, 24*b* and 24*c*, baffling means 26*a*, 26*b* and 26*c*, flues 28*a* and 28*b*, light source means 30, first light detection means 32 and second light detection means 34. In embodiments which incorporate an incandescant bulb as part of light source means 30, one may provide a storage bracket for an additional bulb to facilitate ease of replacement should the incandescant bulb fail. An auxiliary bulb may be retained in a clip bracket which is affixed to the top cover of smoke chamber 14**.

Figure 2:
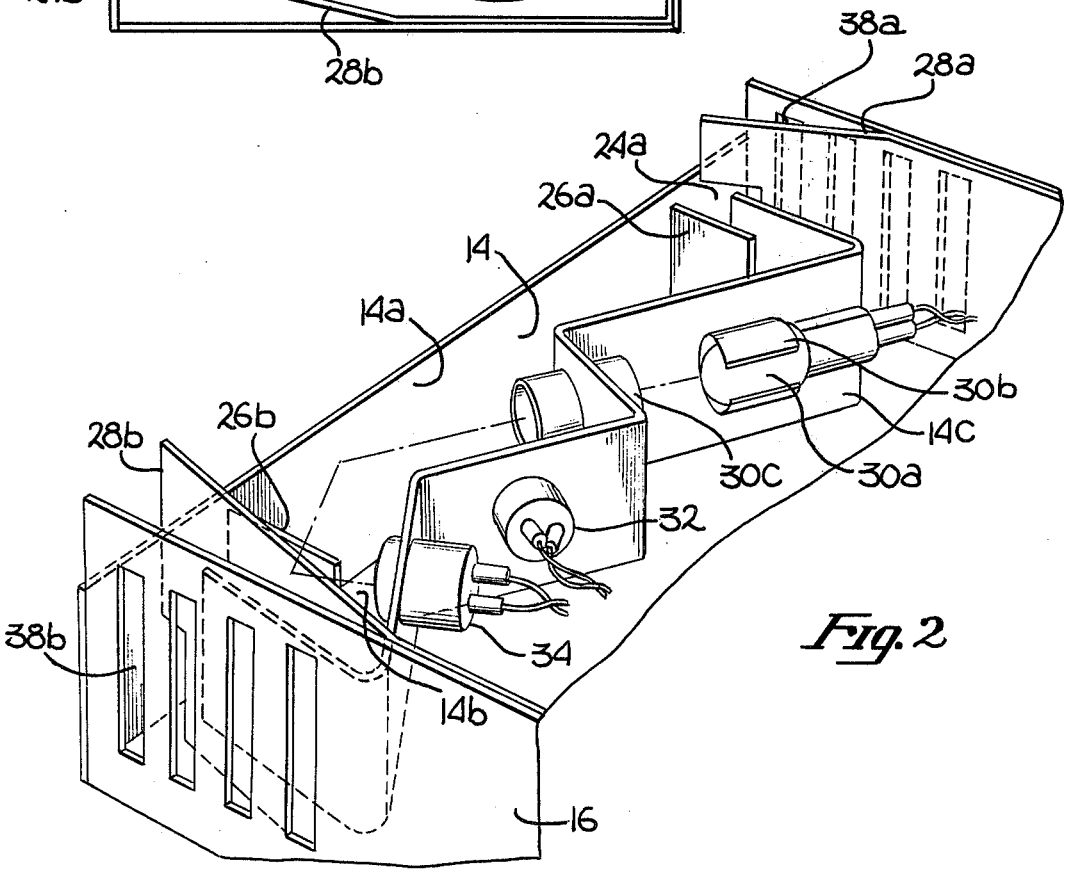
FIG. 2 is a perspective view of the smoke chamber with its cover removed showing two of the three smoke ports together with their flues and baffles. Also illustrated is the relative position of the first and second light detection means, light source means and collimator.
Figure 3:
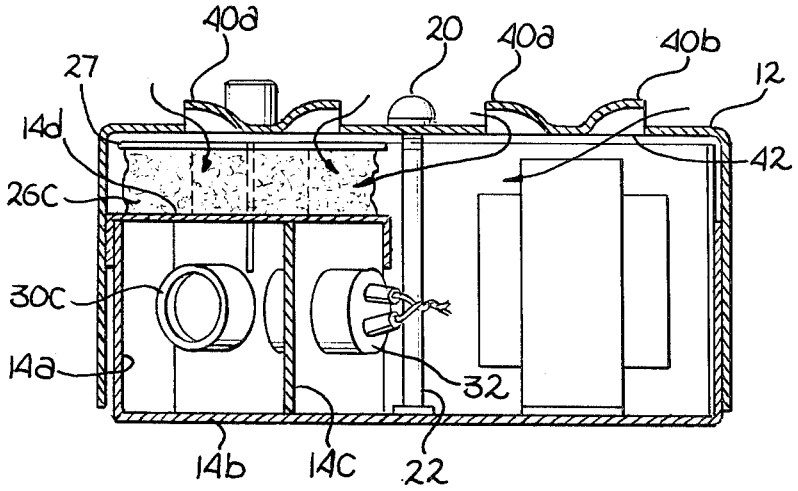
FIG. 3 is a cross section of portions of the smoke alarm through lines 3—3 of FIG. 1 showing the relative position of the louvered array of apertures in the cover to the port on the cover of the smoke chamber, which port is baffled by a reticular foam layer.
Figure 4:
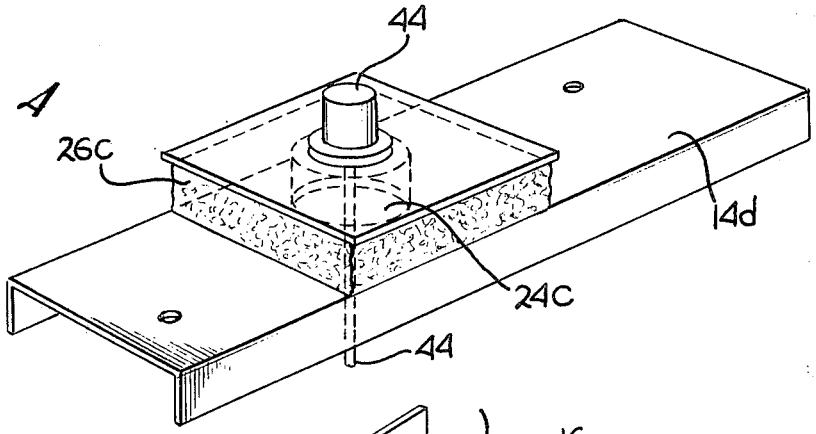
FIG. 4 is a perspective view showing the testing means coupled to the resilient reticular foam layer and extending beyond the smoke chamber cover.

The operation and details of smoke chamber 14 may be better understood by referring to FIG. 2. FIG. 2 illustrates a perspective view of smoke chamber 14. Smoke chamber 14 has a longitudinal axis having apertures **24*a* and 24*b* at the ends thereof. Two walls 14*a* and 14*b* of smoke chamber 14 are common to housing 16. A third wall 14*c* of smoke chamber 14 is formed by a multiply sided wall extending in a direction generally parallel to the longitudinal axis of smoke chamber 14 and forming, in part, smoke ports 24*a* and 24*b*. A fourth wall 14*d* serves to complete the enclosure of smoke chamber 14 and is illustrated in FIGS. 3 and 4. Smoke ports 24*a* and 24*b* are cooperatively defined by walls 14*a*, 14*b*, 14*c* and 14*d* together with baffles 26*a* and 26*b*. Baffles 26*a* and 26*b* are shown as generally planar extensions perpendicular to wall 14*a*. The baffles form together with wall 14*c*, a labyrinth from aperture 24*a* and 24*b* into the interior of smoke chamber 14. In this manner light is substantially prevented from penetrating into smoke chamber 14 while smoke or air is allowed free access. Baffles 26*a* and 26*b* may take any form well known to the art, including that of a reticular foam layer described below in connection with smoke port 24*c* (illustrated in FIG. 4). Smoke chamber 14 may be aided in its operation by flues 28*a* and 28*b*. Thus, smoke laddened air entering apertures 38*a* or 38*b* are channeled by flues 28*a* and 28*b* respectively to the general proximity of apertures 24*a* and 24*b* respectively. For example when smoke alarm 10 is mounted in the configuration shown in FIG. 1, heated smoke laddened air will rise and enter apertures 38*b* and be channeled by a chimney effect by flue means 28*b* into aperture 24*b*. From there the smoke will enter the labyrinth formed by walls 14*a*, *b*, *c*, and *d* and enter smoke chamber 14 where the optical density of the smoke laddened air will be measured. The heated, smoke laddened air will continue along the longitudinal axis of smoke chamber 14 and be exhausted through aperture 24*a*, through flue 28*a* and apertures 38*a***.

Referring now to FIG. 4 a perspective view of wall **14*b* is shown together with aperture 24*c* which is shown in phantom outline. In the preferred embodiment, baffling means 26*c* is a resilient reticular foam layer covered on its upper surface by a nonporous plate 27. Plate 27 serves to prevent the penetration of light through the open reticular foam layer serving as the baffling portion of baffling means 26*c*. In this manner light is substantially prevented from penentrating through port 24*c*** while smoke may freely enter through the sides of the reticular foam layer.

The combination of baffling means **26*c* with an array of apertures 42 in mounting cover 12 is illustrated in cross section in FIG. 3. The array of apertures 42 is shown in combination with oppositely inclined louvers 40*a* and 40*b*. Smoke traveling across cover housing 12 from left to right in FIG. 3 tends to be directed by louvers 40*a* into apertures 42. In the same manner smoke ladden air moving from right to left in FIG. 3 tends to be directed by louvers 40*b* into apertures 42. After entry through apertures 42 the smoke ladden air will tend to flow through the sides of the reticular foam layer forming the baffling portion of baffling means 26*c*. After permeation through baffling means 26*c* smoke enters smoke chamber 14 via port 24*c* whereupon the optical density of the smoke ladden air is measured. The smoke ladden air may continue to flow through smoke chamber 14 and exit through apertures 24*a*, 24*b*** or both.

Figure 6:
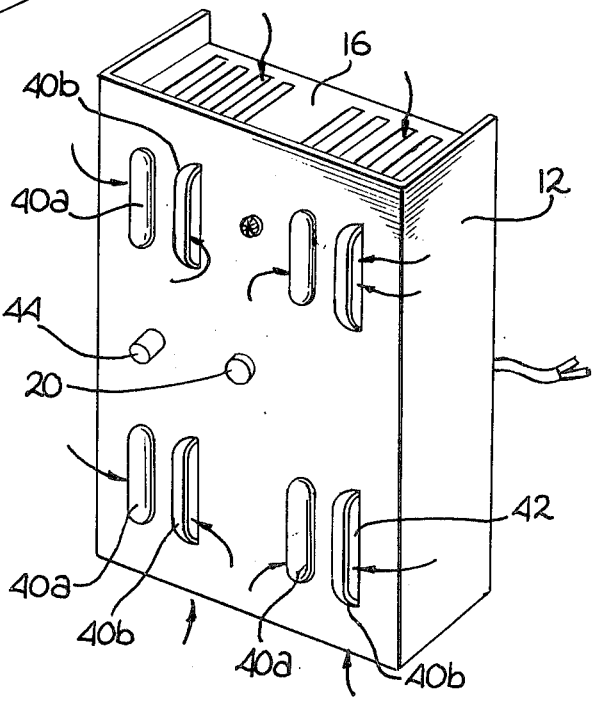
FIG. 6 is a perspective view of the smoke alarm showing the shaft or button portion of the testing means protruding from the smoke alarm cover and showing the hemispherical accessibility of the alarm to smoke laddened air flow.

Thus, as illustrated in FIG. 6 it can be seen that by a combination of baffling means, walls, flues, ports, apertures and louvers, a smoke chamber may be constructed according to the present invention having essentially hemispherical accessibility to smoke ladden air. Due to this hemispherical accessibility, smoke alarm 10 of the present invention may be mounted in at least two configurations, namely, a wall mounted configuration wherein wall 14*a* is substantially vertical, or a ceiling mounted configuration wherein cover housing 12 forms the lowest portion of smoke alarm 10.

The manner by which the optical density of the smoke ladden air is measured and detected may now be better understood by referring again to FIG. 2. In the preferred embodiment light detection means 30 is comprised of an incandescant bulb 30*a*, a heat sink 30*b* and a collimator 30*c*. Bulb 30*a* and heat sink 30*b* are mounted to wall 14*c* exterior to smoke chamber 14. Heat sink 30*b* is thermally coupled to that portion of the surface of bulb 30*b* which would ordinarily transmit light in directions away from collimator 30*c*. As a result of this configuration vaporized matter within incandescant bulb 30*a* tends to to condense on the internal services of bulb 30*a* which are in thermal contact with heat sink 30*b*. Thus, the obscuration of bulb 30*a* over its lifetime is lessened with respect to the intensity of light transmitted from bulb 30*a* toward collimator 30*c*. In the preferred embodiment heat sink 30*b* is a spring clip thermally and mechanically coupled to wall 14*c*. The spring clip grasps bulb 30*a* about its lateral surfaces leaving the end of bulb 30*a*, which is directed towards collimator 30*c*, uncovered. Collimator 30*c* is disposed through wall 14*c* to provide optical access for light generated by bulb 30*a* to the interior of smoke chamber 14. Collimator 30*c* comprises a cylindrical casing and a convex lens disposed therein, which together tend to collimate and focus divergent rays of light from bulb 30*a* into a substantially collimated beam directed into smoke chamber 14.

First light detection means 32 is disposed in wall 14*c* in such direction as to preferentially receive light scattered in a generally perpendicular direction from the beam issuing from collimator 30*c*. Second light detection means 34 is also disposed in a lower portion of wall 14*c* and is directed in such a manner as to preferentially respond to light from the main beam produced by collimator 30*c*. In one embodiment light detection means 34 is disposed so as to preferentially respond to light from the main beam after it has been reflected from wall 14*a* onto baffle 26*b* and thence to light detection means 34. The entire interior surface of smoke chamber 14 is coated with an optically flat black layer, well known to the art, in order to maximize absorption of light incident upon the walls. Thus, by twice reflecting the main beam into light detection means 34, the intensity of light incident upon light detection means 34 may be substantially lessened. In addition, light detection means 34 may be combined with optical filters in order to further reduce light intensity incident on its detecting surface. In the preferred embodiment, both light detection means 32 and 34 are disposed within cylindrical housings to improve the directivity of their response. Furthermore, light detection means 34 is combined with neutral density filters disposed within its cylindrical housing whereby the intensity of light incident upon light detection means 34 may be reduced by approximately a factor of 1000. It is necessary to reduce the light intensity incident upon light detection means 34 to a point where it is approximately equal to the light intensity which will be scattered into light detection means 32 by smoke having the predetermined optical density. This necessity arises from the fact that light detection means 32 and 34 are generally nonlinear devices when operated at low light levels and therefore must be operated at at the same portion of their output curves. Furthermore, detector aging is a function of the light intensities incident upon the detectors as well as the area of the detector which is exposed to light. Thus, in order to provide matched detectors which will be stable over a long lifetime it is necessary to expose both detectors to a similar intensity of light over a substantially equal area of the detector. In the present invention this is accomplished by attenuating the light incident upon light detection means 34 by reflection from absorptive walls and using neutral density filters.

The testing means of the present invention may now be understood in relation to FIGS. 4 and 2. Referring to FIG. 4 the testing means is a wire 46 having a predetermined optical scattering coefficient, typically adjusted by choosing a suitable diameter wire and coating it with a selected optical paint well known to the art. Wire 46 is coupled to shaft 44 which in turn may be affixed to plate 27. Wire 46 extends from a point above wall 14*d* through a generally cylindrical cavity formed within the reticular foam layer of baffling means 26*c*. The wire continues through the cylindrical cavity in the reticular foam layer and port 24*c*. The position of shaft 44 and wire 46 is chosen such that when shaft 44 is depressed, wire 46 moves in a generally downward direction by crushing the resilient foam layer of baffling means 26*c*. Wire 46 then moves into the collimated beam formed by collimator 30*c* within smoke chamber 14. Light is scattered in a predetermined way from wire 46 onto light detection means 32. The scattering coefficient of wire 46 is chosen to be approximately equal to that of a predetermined density of smoke ladden air. In the preferred embodiment smoke alarm 10 is adjusted to trigger an alarm signal when white smoke within chamber 14 reaches an optical density of one percent attenuation per foot. Thus a wire is chosen which is capable of scattering approximately the same amount of light as white smoke having an optical density of 1 percent attenuation per foot.

The reticular foam layer of baffling means 26*c* is substantially resilient so that when the depressing force is removed from shaft 44, wire 46 is withdrawn from the beam within smoke chamber 14 and returned to its original position. Thus, the resilient reticular foam layer of baffling means 26*c* serves a double function as a baffling material and as a spring means for removing wire 46 from the beam. In the preferred embodiment, shaft 44 is shown in FIG. 6 as protruding through housing cover 12 to facilitate easy accessibility thereto. Thus, the entire operation and adjustment of smoke alarm 10 may be easily and conveniently tested without necessitating the removal of any portion of the housing covering smoke alarm 10 or without introducing an actual smoke sample into smoke chamber 14. For example, in a typical installation the smoke alarm is ceiling mounted. The resident may easily test the alarm by depressing shaft 44 by a broomstick or other similar household article.

Figure 5:
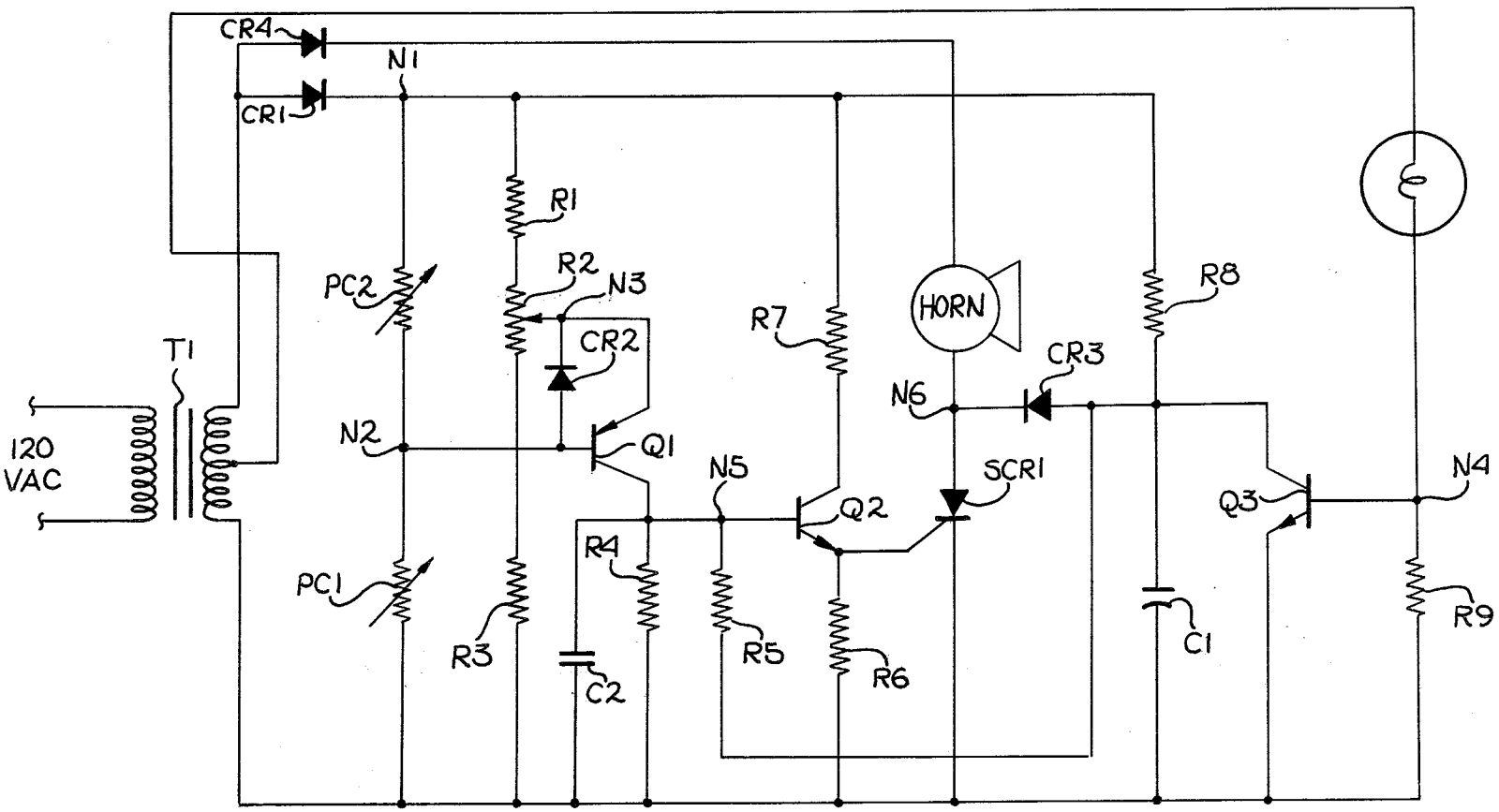
FIG. 5 is a schematic drawing of the circuit means.

The operation of the circuit means may be understood by referring to the schematic illustrated in FIG. 5. The circuit means comprises: (1) A sensing means for comparing electrical responses from first light detection means 32 and second light detection means 34; (2) an alarm means for producing an alarm signal when the electrical response from first light detection means 32 indicates the existence of a predetermined amount of light scattered from the main beam within smoke chamber 14; and (3) a fail-safe means for producing a fail-safe signal when light source means 30 fails to generate light wherein the fail-safe signal is a distinguishable signal from the alarm signal.

The sensing means is a wheatstone bridge having light detection means 32 and 34 as one series pair of the bridge. In the preferred embodiment light detection means 32 and 34 are semiconductor photoelectric cells. In particular, first light detection means 32 is photoelectric cell PCI and second light detection means 34 is photoelectric cell PC2. The other series pair of the wheatstone bridge is formed by purely resistive elements R1, R2 and R3. The wheatstone bridge is connected to a power supply which in turn is comprised of a transformer T1 and two parallel semiconductor diodes CR1 and CR4. The output of the wheatstone bridge is taken across nodes N2 and N3. Node N3 is coupled to the wiper of a potentiometer R2. Potentiometer R2 is adjusted so that when photoelectric cell PC1 (first light detection means 32) is irradiated by light equal to that amount which would scatter from smoke having an optical density of 1 percent attenuation per foot, semiconductor transistor Q1 will be turned on. The voltage divider R1, R2 and R3 are chosen to have relatively low impedances in comparison to photoelectric cells PC1 and PC2. Because potentiometer R2 has a relatively low impedance, leakage currents created across the resistor by the effects of humidity tend to have an insignificant effect. In other words, the leakage currents caused by humidity form virtual resistors coupled in parallel across the two halves of potentiometer R2. Since in the preferred embodiment the impedance of R2 is approximately 2.5 K ohms such virtual leakage resistors tend to have little effect. Thus, the sensing means for comparing the electrical response or impedances of photoelectric cell PC1 and photoelectric cell PC2 is devised so as to be substantially independent of changes in relative humidity. This independence and advantage result from the fact that low impedance potentiometers typically have a high humidity tolerance obtainable at no additional cost or difficulty, which does not characterize high impedance potentiometers.

When there is no smoke in smoke chamber 14 the resistance of photoelectric cell PC1 will be substantially larger than that of photoelectric cell PC2. The voltage divider comprised of resistors R1, R2 and R3, is adjusted to provide at node N3 about half of the DC component produced by the power supply. Therefore, the voltage at node N2 will generally be higher than the voltage at node N3. Thus, transistor Q1 will normally be turned off. When light is scattered from smoke within smoke chamber 14, the resistance of photoelectric cell PC1 will decrease. Therefore, the voltage at node N2 will decrease causing transistor Q1 to conduct. The equivalent impedance of the voltage divider, comprised of resistors R1, R2 and R3, also serves as a current limiting resistor for transistor Q1. Resistor R4 is chosen to have a high enough value to prevent leakage currents from Q1 at the maximum operating temperatures from turning on transistor Q2. Capacitor C2 provides a short circuit path to ground for voltage spikes from transistor Q1 which in turn might be caused by spikes on the power line. Typically such spikes result from putting sudden loads onto the power line. Diode CR2 serves as a voltage protection limiter for transistor Q1 to protect against reverse bias current leaking from the base of Q1 to its emitter when transistor Q1 is turned off. Prolonged reverse current leakages of a few microamperes may severely degrade the beta or Hfe of transistor Q1, thereby altering the overall sensitivity of the smoke alarm. Diode CR2 thus serves to limit the reverse current leaking by keeping the emitter of transistor Q1 within about one threshold voltage (0.4 volt) of the base, well below the base to emitter reverse breakdown voltage.

When transistor Q1 conducts, this in turn causes transistor Q2, which is an emitter follower, to conduct. Again, resistor R7 serves as a current limiter to transistor Q2 and resistor R6 serves to bias and prevent leakage currents from triggering the gate of the silicon controlled rectifier SCR1. Therefore, when light is scattered onto photoelectric cell PC1 causing its resistance to decrease, transistor Q1 conducts which in turn turns on transistor Q2. As a result the silicon controlled rectified SCR1 is gated on and an alarm signal is generated by a transducer. In the preferred embodiment the alarm signal is a loud, continuous tone provided by a horn. It should be noted that the alarm is self-cancelling. Should the smoke be dissipated, the alarm will automatically be silenced without any other intervention.

The fail-safe means comprises a relaxation oscillator triggered by transistor Q3. In the preferred embodiment the light source means is an incandescant bulb which is coupled between a center tap on the transformer T1 and the base of transistor Q3. The lower voltage provided by the transformer tap serves to extend the life of lamp L1. Lamp L1 is provided with unrectified AC current, so that when node N4 is driven positive, transistor Q3 will turn on. Likewise, transistor Q3 will turn off when node N4 is driven negatively. Thus, during each half cycle transistor Q3 discharges capacitor C1 which, but for the operation of transistor Q3, would be fully charged through resistor R8. Because a substantial amount of current flows through the lamp and resistor R9, transistor Q3 must be a relatively large geometry device in order to operate satisfactorily under the large base currents which are delivered to node N4. In the preferred embodiment, resistor R9 is assigned a low impedance in order to limit the reverse bias voltage applied to the base of transistor Q3 when node N4 is driven negatively, and to shunt from transistor Q3 significant current during the positive half cycles.

Should the filament in lamp L1 burn out or open circuit, transistor Q3 will no longer be turned on during the positive swings at node N4. Thus, a significant amount of charge will accumulate on capacitor C1. Resistors R4 and R5 form a voltage divider coupled between capacitor C1 and ground. Resistors R4 and R5 apply a selected ratio of the voltage across capacitor C1 to node N5. As the voltage across capacitor C1 exponentially rises, the voltage applied to node N5 will also rise causing transistor Q2 to conduct after the base to emitter threshhold voltage is surpassed. This will turn on the gate of the silicon controlled rectifier SCR1 and pull node N6 essentially to ground. During the interval when silicon controlled rectifier SCR1 is conductive the alarm transducer or horn will sound. Thus, diode CR3 will conduct and quickly discharge capacitor C1. As the voltage across capacitor C1 decreases, the voltage applied to node N5 will also decrease. Transistor Q2 will subsequentially turn off causing the voltage applied to the gate of the silicon controlled rectifier SCR1 to fall. Thus, silicon controlled rectifier SCR1 will become nonconductive on the next negative half cycle allowing the voltage at node N6 to rise and reverse bias diode CR3. Once again capacitor C1 will begin to exponentially charge up by current provided through resistor R8 and the cycle is repeated to generate an intermittant fail-safe signal. In this manner a periodic alarm signal is sounded when the filament of lamp L1 open circuits and is easily distinguishable from the continuous alarm provided when light is scattered onto the detecting surface of photoelectric cell PC1.

An optical fail-safe means may also be provided which will function in the event that the circuit means fails to generate a fail-safe signal. FIG. 6 illustrates such an optical fail-safe means which may be a light conducting rod 48. Light conducting rod 48 is a solid, cylindrical segment of transparent plastic which extends through cover 12. One end of rod 48 terminates in a head having a multiplicity of facets, to serve a decorative purpose and to provide a large number of lighted faces oriented in a large number of directions. The opposite end of rod 48 terminates in a flat face in the proximity of light source means 30. Therefore, a portion of the light emitted from light source means 30 is captured by rod 48 and is transmitted by means of internal reflections along its length to the head of rod 48 protruding from cover 12. Thus, should the fail-safe circuit fail to operate, the failure of light source means 30 may still be conveniently detected by inspection of an optical fail-safe means.

It may now be understood that the bridge network of the preferred embodiment of the present invention incorporates several self-calibrating features. For example, photoelectric cell PC1 and PC2 are matched photoelectric cells and are employed as described above in such a manner that substantially equal intensities of light are incident on them across substantially equal areas of the detector surface so that detector aging is uniform. Thus, gradual changes in the characteristics of photoelectric cell PC2 are matched to a first degree by similar changes in the characteristics of the photoelectric cell PC1 and the circuit remains stable and operational. Moreover, the operation of the circuit is not influenced by voltage drifts in the voltage supply nor by gradual temperature changes in the photoelectric cells because of the bridge design. Finally, it should be noted that the smoke alarm is calibrated to produce an alarm signal when white smoke enters smoke chamber 13 and has an optical density of at least 1 percent attenuation per foot. In the case that black smoke should enter smoke chamber 14 the amount of light scattered from the beam into photo cell PC1 is substantially decreased. Therefore, if there were no compensation, it would require a substantially higher optical density to trigger the smoke alarm than would be the case with white smoke. However, according to the present invention if black smoke should enter smoke chamber 14 the amount of light incident upon photo cell PC2 would likewise decrease due to the obscuration of the beam. As the light intensity upon photo cell PC2 decreases, the resistance of photo cell PC2 increases. Thus, the impedance of photo cell PC1, which is normally high, must decrease by a lessor absolute amount than is the case with white smoke, in order to provide sufficient voltage at node N2 to trigger the smoke alarm. In this manner the smoke alarm is self-compensating for smoke such as black smoke which has a relatively lower coefficient of scattering and a relatively higher coefficient of obscuration. In practice when the smoke alarm is set to trigger at a 1 percent attenuation per foot for white smoke, it will trigger at about 5 percent attenuation per foot in the case of black smoke.

Further modifications and alterations may be made by those with ordinary skill in the art without departing from the scope and spirit of the present invention.

I claim:

1. A smoke alarm for detecting smoke in air comprising:

a light shielded smoke chamber defining a generally closed space having a longitudinal axis with a first and second port provided in said chamber at each end of said longitudinal axis, and having a third port disposed on an axis substantially perpendicular to said longitudinal axis, each of said ports having a baffling means for preventing the entry of light without substantially interfering with the entry of smoke through each of said ports into said chamber, at least one of said baffling means being a reticulated foam layer disposed across one of said ports, said reticulated layer having a nonporous plate disposed thereon whereby light is substantially prevented from penetrating said layer while smoke is permitted to enter said layer and aperture through the sides of said layer;

an array of louvered apertures proximately disposed to said third aperture, said array of apertures having louvers oriented with opposite inclinations whereby smoke flowing perpendicular to said longitudinal axis of said chamber is directed toward said third aperture regardless of direction of flow;

a flue means for directing smoke flowing parallel to said longitudinal axis of said chamber into said first and second ports;

an incandescant bulb and lens assembly to provide a beam of collimated light said bulb thermally coupled to a heat sink at selected portions of said bulb whereby vaporized matter within said incandescant bulb is induced to condense on said selected portions of said bulb thermally coupled to said heat sink and light produced by said bulb and directed into said collimated beam is substantially unattenuated by condensation of said vaporized matter;

a first photoelectric cell to provide an electrical response upon the irradiation by light scattered from said collimated beam, said scattered light beam scattered by smoke dispersed into said chamber;

a second photoelectric cell to produce an electrical response upon the radiation by light from said beam;

a power supply to provide a source of electrical power;

a wheatstone bridge having four circuit segments coupled to said power supply and grouped in a first and second series pair said first and second series pairs being coupled in parallel, said first series pair being said first and second photoelectric cell and said second series pair being low impedance electrical resistors, one of said resistors being a low impedance variable resistor, whereby said wheatstone bridge is substantially unaffected by changes in relative humidity;

an alarm means coupled to said wheatstone bridge for producing an alarm signal when said first photoelectric cell responds to a measured increase of light scattered from smoke within said chamber and for silencing said alarm signal when said first photoelectric cell responds to a measured decrease of light scattered from smoke within said chamber;

a relaxation oscillator coupled to said incandescant bulb, said relaxation oscillator being triggered when said incandescant bulb becomes open circuited, whereby a fail-safe signal is produced which is distinguishable from said alarm signal; and a coated wire having a predetermined optical scattering coefficient to simulate the scattering of light from smoke within said chamber, said wire removably disposed in said beam by a spring means and a shaft coupled to said wire, said shaft extending from said smoke alarm to allow manual depression to dispose said wire into said beam, said spring means for encouraging said wire from said beam when said shaft is not depressed.

2. A smoke alarm for detecting smoke comprising:

a light shielded smoke chamber having at least two ports provided therein to permit smoke dispersed in air to flow through a space defined by said chamber;

a light source means for providing a beam of collimated light, said beam propagating through at least a portion of said space defined by said chamber, wherein said light source means includes an incandescant bulb thermally coupled to a heat sink at portions of said bulb propagating light in directions other than the direction of said collimated beam, whereby vaporized matter within said incandescant bulb is induced to condense on portions of said bulb thermally coupled to said heat sink and light produced by said bulb and directed into said collimated beam is substantially unattenuated by condensation of said vaporized matter;

a first light detection means for producing an electrical response upon irradiation by light scattered from said beam, said scattered light being scattered by smoke dispersed in said portion of said chamber having said beam propagating therethrough;

a second light detection means for producing an electrical response upon irradiation by light from said beam; and a circuit means for comparing said electrical responses from said first and second light detection means to produce at least one alarm signal in response to light scattered from smoke within said chamber.

3. In a smoke alarm having a light source, a power supply, a sensing circuit with an output detection signal, a gate controlled rectifier, and an alarm transducer wherein said light source, sensing circuit and alarm transducer are coupled to said power supply, the anode of said gate controlled rectifier is coupled to said alarm transducer and is gated by a control signal from an alarm trigger means, said alarm trigger means being coupled to said sensing circuit and said alarm trigger means for responding to said output detection signal by generating said control signal, a relaxation oscillator for generating a distinct lamp failure alarm comprising:

a passive network having a chargeable node, said chargeable node being coupled to the input of said alarm trigger means;

a diode having its anode coupled to said chargeable node of said passive network and its cathode coupled to said anode of said gate controlled rectifier; and relaxation trigger means having an input coupled to said light source and an output coupled to said chargeable node for maintaining said chargeable node in a substantially discharged condition when the impedance of said light source is less than a predetermined value.

4. The relaxation oscillator to claim 3 wherein said passive network is a series RC circuit, said relaxation trigger means includes a semiconductor transistor having its base coupled to said light source, its collector coupled to said chargeable node and its emitter coupled to ground.

5. A smoke alarm comprising:

a light shielded smoke chamber having at least two ports provided therein to permit smoke dispersed in air to flow through a space defined by said chamber;

light source means for providing a beam of light through at least a portion of said space defined by said chamber;

means for detecting light scattered by smoke from said beam for light and for generating at least one alarm signal; and a heat sink thermally coupled to said light source at portions of said light source propagating light in directions other than the direction of said beam of light so that vaporized matter within said light source is induced to condense on portions of said light coupled to said heat sink and light produced by said light source and directed into said beam is substantially unattenuated by condensation of said vaporized matter.

* * * * *